US008935975B2

(12) United States Patent
Stevenson

(10) Patent No.: US 8,935,975 B2
(45) Date of Patent: Jan. 20, 2015

(54) INCENDIARY MACHINE

(75) Inventor: Robert Andrew Stevenson, Jandakot (AU)

(73) Assignee: Raindance Systems Pty Ltd, Western Australia (AU)

( * ) Notice: Subject to any disclaimer, the term of this patent is extended or adjusted under 35 U.S.C. 154(b) by 218 days.

(21) Appl. No.: 13/582,411

(22) PCT Filed: Mar. 2, 2011

(86) PCT No.: PCT/AU2011/000232

§ 371 (c)(1),
(2), (4) Date: Nov. 12, 2012

(87) PCT Pub. No.: WO2011/106835

PCT Pub. Date: Sep. 9, 2011

(65) Prior Publication Data

US 2013/0061738 A1 Mar. 14, 2013

(30) Foreign Application Priority Data

Mar. 2, 2011 (AU) ..... 2010900875

(51) Int. Cl.
*B64D 1/04* (2006.01)
*F42B 12/44* (2006.01)
*F41B 4/00* (2006.01)

(52) U.S. Cl.
CPC .. *F42B 12/44* (2013.01); *F41B 4/00* (2013.01)
USPC ..... 89/1.51; 89/1.52; 89/1.1; 102/364; 102/336

(58) Field of Classification Search
CPC ..... F42B 3/198; F42B 5/307; B23P 19/04; A62C 99/00; A62C 3/02; B64D 1/04; F41F 5/00
USPC ..... 86/10–19; 89/1.51, 1.52, 1.1; 102/364, 102/365, 335, 346, 336; 169/52, 36, 45, 46, 169/54, 70
See application file for complete search history.

(56) References Cited

U.S. PATENT DOCUMENTS 1,332,022 A 2/1920 Becker
1,632,414 A 6/1927 Nosan
(Continued)

FOREIGN PATENT DOCUMENTS

GB 245244 1/1926
WO 2004/041365 5/2004
(Continued)

OTHER PUBLICATIONS

Aug. 10, 2000, RD 436051 A (Anonymous) abstract.
(Continued)

*Primary Examiner* — Samir Abdosh
(74) *Attorney, Agent, or Firm* — Neifeld IP Law, PLLC

(57) ABSTRACT

An incendiary machine (10) comprises a feed and dispensing system (12), a priming system (20) and a control system. The feed and dispensing system (12) feeds a belt (14) of incendiary capsules (16) to a region at which individual capsules are separated from the belt and dispensed from the machine (10). The priming system (20) primes the capsule (16) prior to being dispensed from the machine (10) with a priming liquid which, when delivered into a capsule, facilitates an exothermic reaction. The control system controls the feed and dispensing system (12), and the priming system (20) independently of each other so that the belt (14) can be fed into and indeed thought the machine (10) with the priming liquid being injected into the capsules.

23 Claims, 14 Drawing Sheets

(56) References Cited

U.S. PATENT DOCUMENTS

| | | | | |
|---|---|---|---|---|
| 1,721,883 | A | 7/1929 | Louis et al. | |
| 2,278,949 | A | 4/1942 | Sabini | |
| 2,347,163 | A | 4/1944 | Kraft et al. | |
| 2,442,381 | A | 6/1948 | Short | |
| 2,646,786 | A | 7/1953 | Henry | |
| 3,448,654 | A | 6/1969 | Crabtree et al. | |
| 3,519,221 | A | 7/1970 | Kifor | |
| 3,780,655 | A | 12/1973 | Allen et al. | |
| 3,951,068 | A | 4/1976 | Schroeder | |
| 3,979,850 | A | 9/1976 | Schiessl et al. | |
| 4,015,355 | A | 4/1977 | Schiessl et al. | |
| 4,141,274 | A | 2/1979 | Gerber | |
| 4,696,347 | A | 9/1987 | Stolov et al. | |
| 5,168,123 | A | 12/1992 | Lee | |
| 5,267,501 | A | 12/1993 | Shillig | |
| 5,783,768 | A | 7/1998 | Jacobson | |
| 5,997,667 | A | 12/1999 | Jacobson | |
| 6,877,433 | B1 | 4/2005 | Stevenson | |
| 7,083,000 | B2 | 8/2006 | Edwards et al. | |
| 7,210,537 | B1 | 5/2007 | McNeil | |
| 7,275,529 | B2 | 10/2007 | Boys | |
| 7,451,679 | B2 * | 11/2008 | Stevenson et al. | 89/1.51 |
| 2003/0006319 | A1 | 1/2003 | Silverstein et al. | |
| 2007/0007021 | A1 | 1/2007 | Regan | |
| 2010/0101401 | A1 * | 4/2010 | Toeckes et al. | 89/1.51 |

FOREIGN PATENT DOCUMENTS

| | | |
|---|---|---|
| WO | 2008/104061 | 9/2008 |
| WO | 2009/059367 | 5/2009 |

OTHER PUBLICATIONS

Feb. 9, 2004, International Search Report PCT/AU2003/001477.

Sep. 9, 2011, International Search Report PCT/AU2011/000232.

2004, Premo MK III Aerial Ignition System, Operations Handbook, SN 0308-394AF, Year of Manufacture: 2004.

* cited by examiner

INCENDIARY MACHINE

CROSS REFERENCE TO RELATED APPLICATIONS

This application is a national stage entry of PCT/AU2011/000232, filed Mar. 2, 2011, which claims priority to AU Application No. 2010900875, filed Mar. 2, 2010.

FIELD OF THE INVENTION

The present invention relates to an incendiary machine, in particular, but not exclusively, for aerial dispensing of incendiary capsules.

BACKGROUND OF THE INVENTION

It is known to drop incendiaries from aircraft including helicopters, light planes and unmanned or remote controlled air craft. One known incendiary is in the form of a small ball (approximately 32 mm in diameter) filled with a quantity of potassium permanganate powder or granules. A semi-automatic dispenser is available having a hopper which holds a supply of balls and feeds the balls sequentially to a chute where they are injected with a volume of glycol. The potassium permanganate and glycol react exothermically to generate a flame. Applicant has previously developed an alternate apparatus for initiating and dispensing incendiaries. This apparatus is described in International publication no. WO 2004/041365. Following extensive research and experimentation, Applicant has made further developments in the area of aerial incendiary delivery.

SUMMARY OF THE INVENTION

In one aspect the invention provides an incendiary machine comprising:

- a feed and dispensing system capable of feeding a belt of incendiary capsules to a region at which individual capsules are separated from the belt and dispensed from the machine;
- a priming system capable of priming the capsules prior to being dispensed from the machine, the priming system having a pump for pumping a priming liquid which, when delivered into a capsule, facilitates an exothermic reaction; and,
- a control system capable of controlling the feed and dispensing system, and the priming system independently of each other.

The control system may be configured to selectively enable an operator to dispense primed incendiaries either: automatically at a user defined rate; or, manually on each manual operation of a control button or switch.

The control system may comprise a user interface enabling a user to set a rate of automatically dispensing primed incendiaries.

The control system may comprise at least one incendiary sensor for detecting the presence of an incendiary belt in the machine.

The control system may be configured to prevent operation of the priming system when the at least one incendiary sensor fails to detect the presence of an incendiary belt in the machine.

The control system may be operable to perform a LOAD function wherein the control system operates the feed and dispensing system to load a belt of incendiaries to a position where priming system is capable of priming the capsules.

The control system may be operable to perform a PRIME function which primes the priming system with priming fluid prior to feeding of the belt to the region.

The priming system may comprise an injection device capable of piercing the capsules to deliver the priming liquid to the capsules.

The feed and dispensing system may comprise a blade commonly mounted with the injection device and arranged to separate a capsule from the belt substantially simultaneously with the injection device injecting the priming liquid into the capsule.

The feed and dispensing may comprise a carousel provided with a plurality of recesses for seating respective capsules in the belt.

The feed and dispensing may comprise a channel extending from an inlet for the belt to the carousel and a biased plate arranged to bias a capsule into a recess of the carousel.

The incendiary machine may comprise a drive system arranged to drive the feed and dispensing system, the drive system comprising a first motor under the control of the control system.

The drive system may comprise a plurality of cogs mounted on respective shafts and operatively coupled together where torque imparted by the first motor to one of the cogs drives the operatively coupled cogs.

A first cog may be coupled with the carousel and a second cog may be coupled to the blade and injection device, and the drive system may further comprise an endless belt coupling the first cog to the second cog wherein torque from the first motor drives both the carousel and the blade and injection device.

The incendiary machine may comprise a pump motor operable to drive the pump, wherein the control system is operable to control the first motor and pump motor independently of each other.

The incendiary machine may comprise a housing in which the feed and dispensing system and the priming system are housed and a frame arranged to demountably support the housing and to support an incendiary belt feed.

The incendiary machine according may comprise a tray pivotally coupled to the frame and on which the incendiary belt feed is supported.

A second aspect of the invention provides an incendiary machine comprising:

- a feed and dispensing system capable of feeding a belt of incendiary capsules to a region at which individual capsules are separated from the belt and subsequently dispensed from the machine;
- a first motor which drives the feed and dispensing system;
- a priming system capable of priming capsules prior to being dispensed from the machine, the priming system having a pump for pumping a priming liquid, and an injection device capable of piercing the capsule to deliver the priming liquid to the capsule;
- a second motor which drives the pump; and,
- a control system capable of independently controlling the first and second motors enabling control of flow of the priming liquid independent of operation of the feed and dispensing system.

The control system may be configured to selectively enable an operator to dispense primed incendiaries either: automatically at a user defined rate; or, manually on each manual operation of a control button or switch.

The control system may comprise a user interface enabling a user to set a rate of automatically dispensing primed incendiaries.

The control system may comprise at least one incendiary sensor for detecting the presence of an incendiary belt in the machine.

The control system may be configured to prevent operation of the priming system when the at least one incendiary sensor fails to detect the presence of an incendiary belt in the machine.

The control system may be operable to perform a LOAD function wherein the control system operates the feed and dispensing system to load a belt of incendiaries to a position where priming system is capable of priming the capsules.

The control system may be operable to perform a PRIME function which primes the priming system with priming fluid prior to feeding of the belt to the region.

BRIEF DESCRIPTION OF THE DRAWINGS

Embodiments of the present invention will now be described by way of example only with reference to the accompanying drawings in which.

DETAILED DESCRIPTION OF PREFERRED EMBODIMENTS

Figure 1:
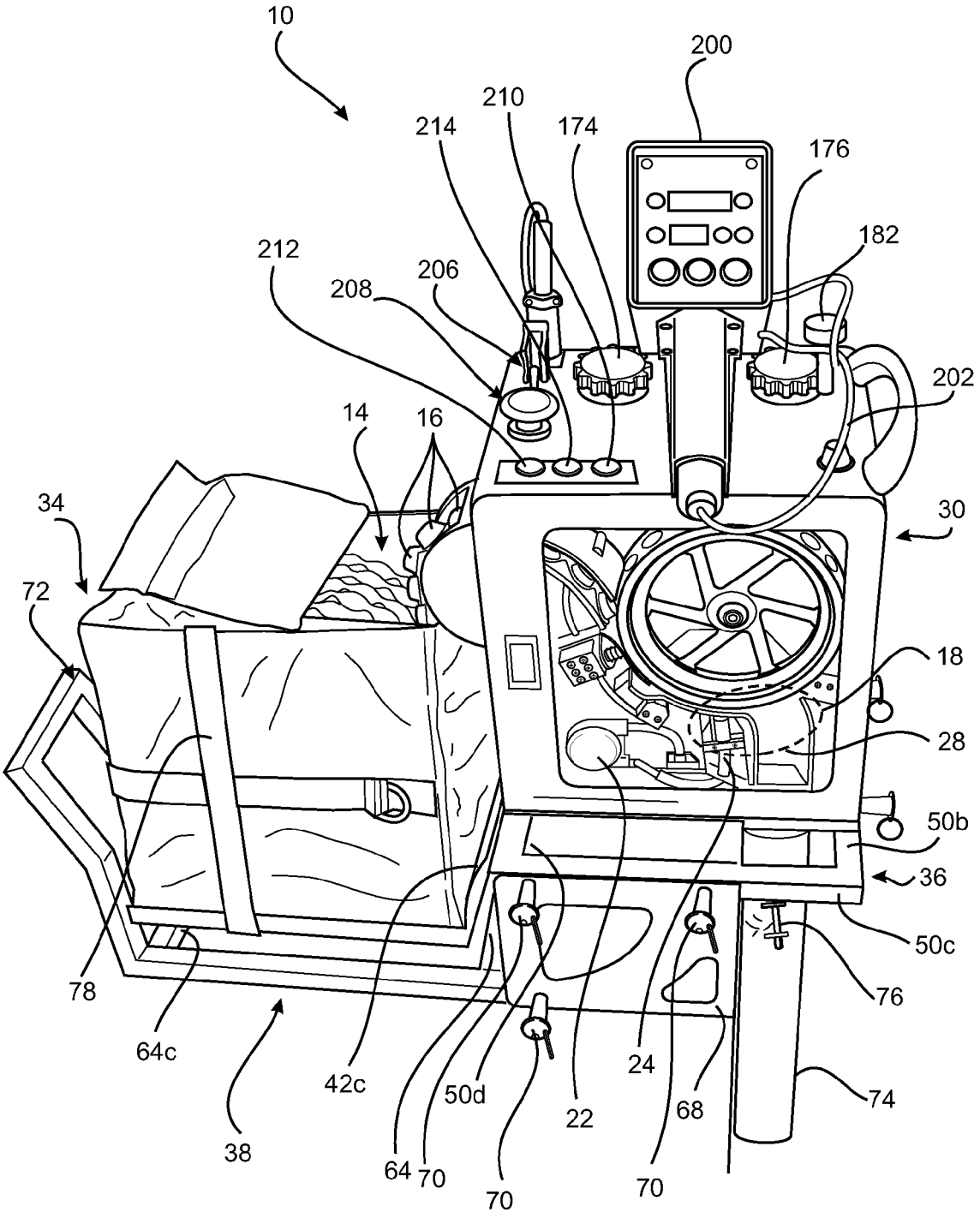
FIG. 1 is a representation of an embodiment of an incendiary machine in accordance with the present invention.
Figure 2:
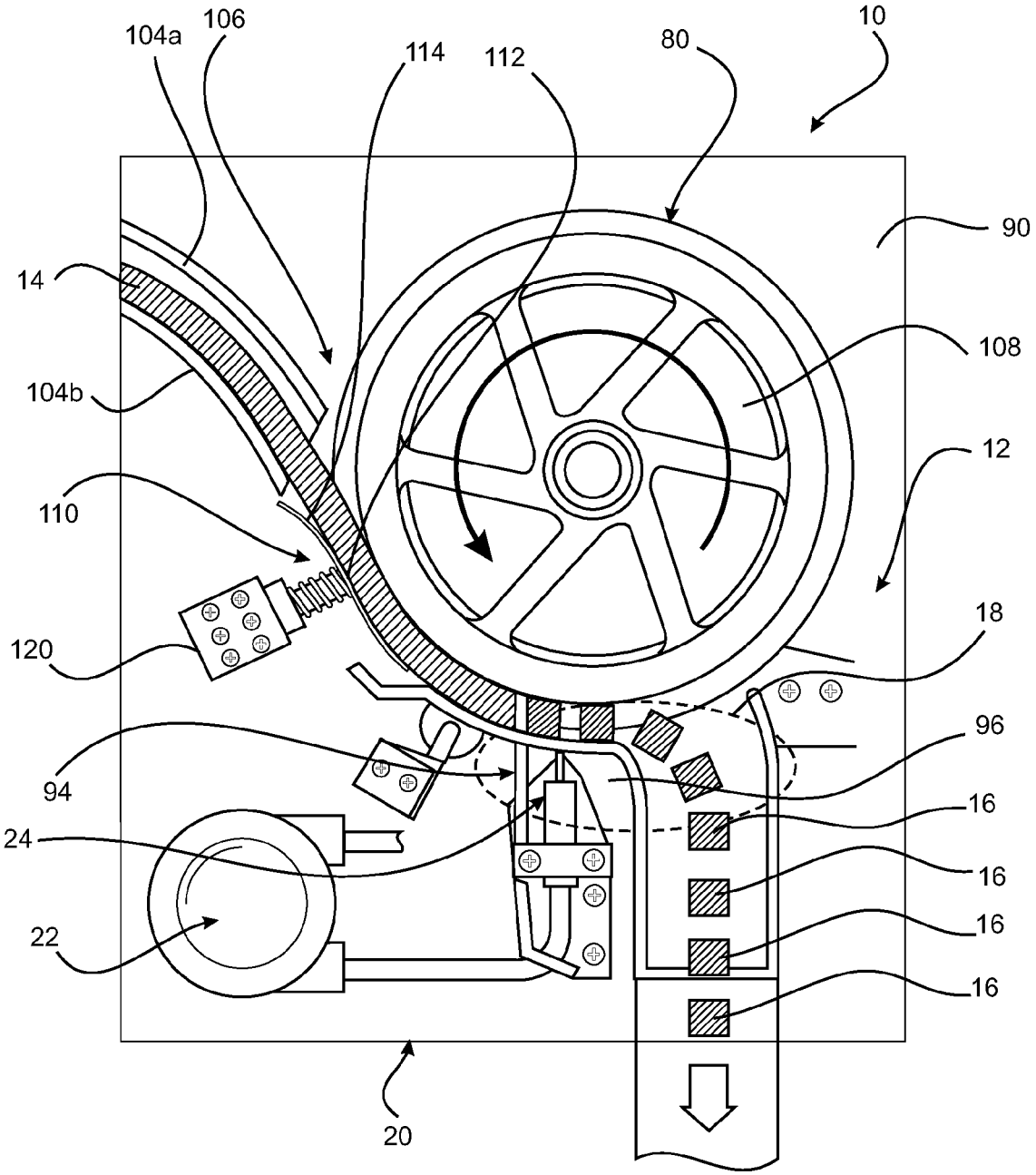
FIG. 2 is a schematic representation of a feed and dispensing system and, a priming system incorporated in the machine.

With reference to the accompanying drawings and in particular FIGS. 1 and 2, an embodiment of an incendiary machine 10 in accordance with the invention comprises a feed and dispensing system 12 capable of feeding a belt 14 of incendiary capsules 16 to a region 18 where individual capsules which are separated from the belt and dispensed from the machine 10. The machine 10 also has a priming system 20 capable of priming the capsules 16 prior to being dispensed from the machine 10. The priming system 20 includes a pump 22 for pumping a priming liquid, such as ethylene glycol, and an injection device 24 which can pierce a capsule 16 to deliver the priming liquid to the capsule 16. The machine 10 also includes a control system which is capable of individually controlling the feed and dispensing system 12 and the priming system 20. This allows for example the feed and dispensing system 12 to operate to feed the belt 14 of incendiaries 16, separated individual incendiary capsules 16 from the belt 14 and deliver them to a dispensing chute 28 from which they can be dispensed without supplying the priming liquid to the priming system 20. Additionally, the control system enables the pumping system 20 to be primed irrespective of whether or not the feed and dispensing system 12 is in operation. The belt 14 and capsules 16 can be of a type described in U.S. Pat. No. 6,877,433. In brief each capsule may comprise a small container of a thin walled plastics material and hold a volume of potassium permanganate.

Referring to FIGS. 1 and 3-6 the machine 10 is seen as comprising a dispenser housing 30 which houses the feed and dispensing system 12, the priming system 20, and the control system; and a frame 32 on which the dispenser housing 30 is disposed. The frame is also configured to support a box 34 holding an incendiary feed supply of one or more incendiary belts 14. The frame 32 has a step configuration having a first portion 36 on which the housing 30 is demountably supported and a second portion 38 which lies in a parallel plane to the portion 36 but is off set below the portion 36 and on which the box 34 is supported. A tilting tray 40 is pivotally coupled to the frame portion 38. Tray 40 is provided with upstanding walls 42*a*, 42*b*, 42*c* and 42*d* (hereinafter referred to in general as "walls 42") within which the box 34 is seated on the tray 40. The walls 42*a* and 42*b* are relatively low in height and contiguous with each other extending about adjacent edges of the tray 40. The wall 42*c* extends along another edge of the tray 40 between the walls 42*b* and 42*d* and is on a side of the tray 40 adjacent the housing 30. The wall 42*c* is convexly curved when viewed in a direction from wall 42*a* to wall 42*c*. The curvature of the wall 42*c* is such that an upper edge 44 of the wall 42*c* lies in close proximity to though slightly spaced from the first frame portion 36. The spacing is arranged so as to minimise the likelihood of the belt 14 getting caught between the tray 40 and the frame 32.

Figure 3:
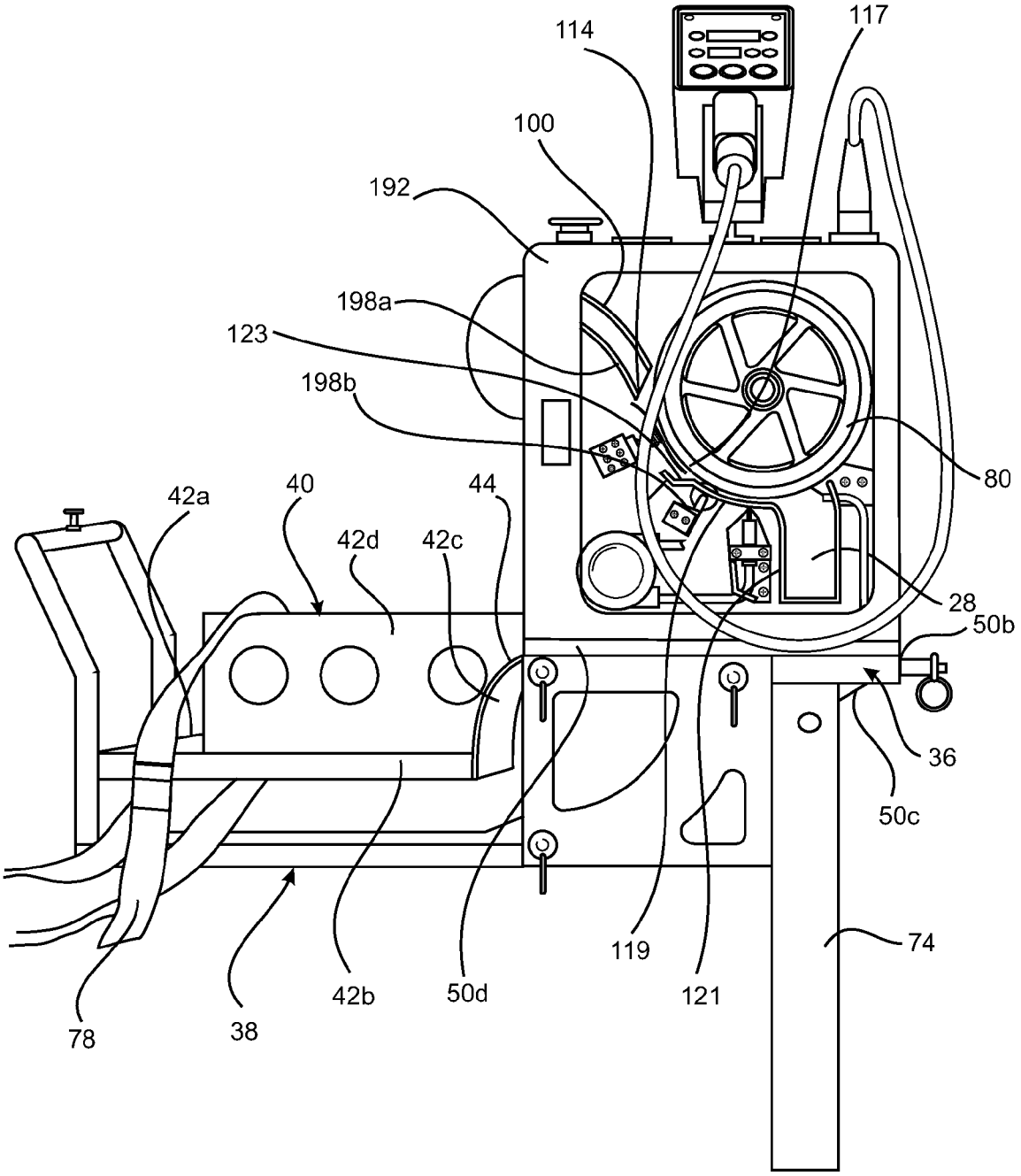
FIG. 3 is a representation of the machine shown in FIG. 1 but taken from a different angle and in which a box of incendiaries for the machine has been removed.
Figure 4:
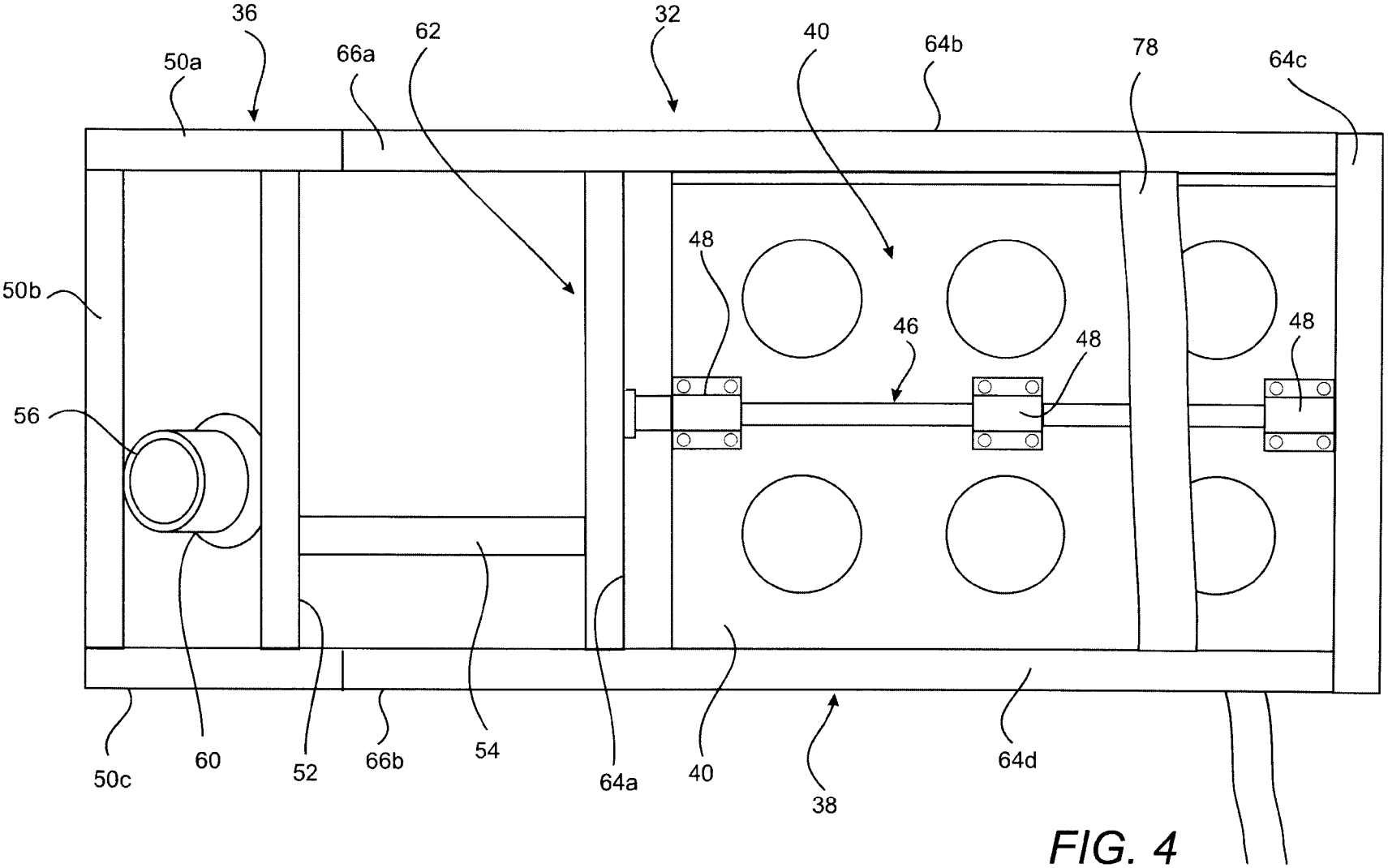
FIG. 4 is a bottom view of a frame incorporated in the machine.
Figure 5:
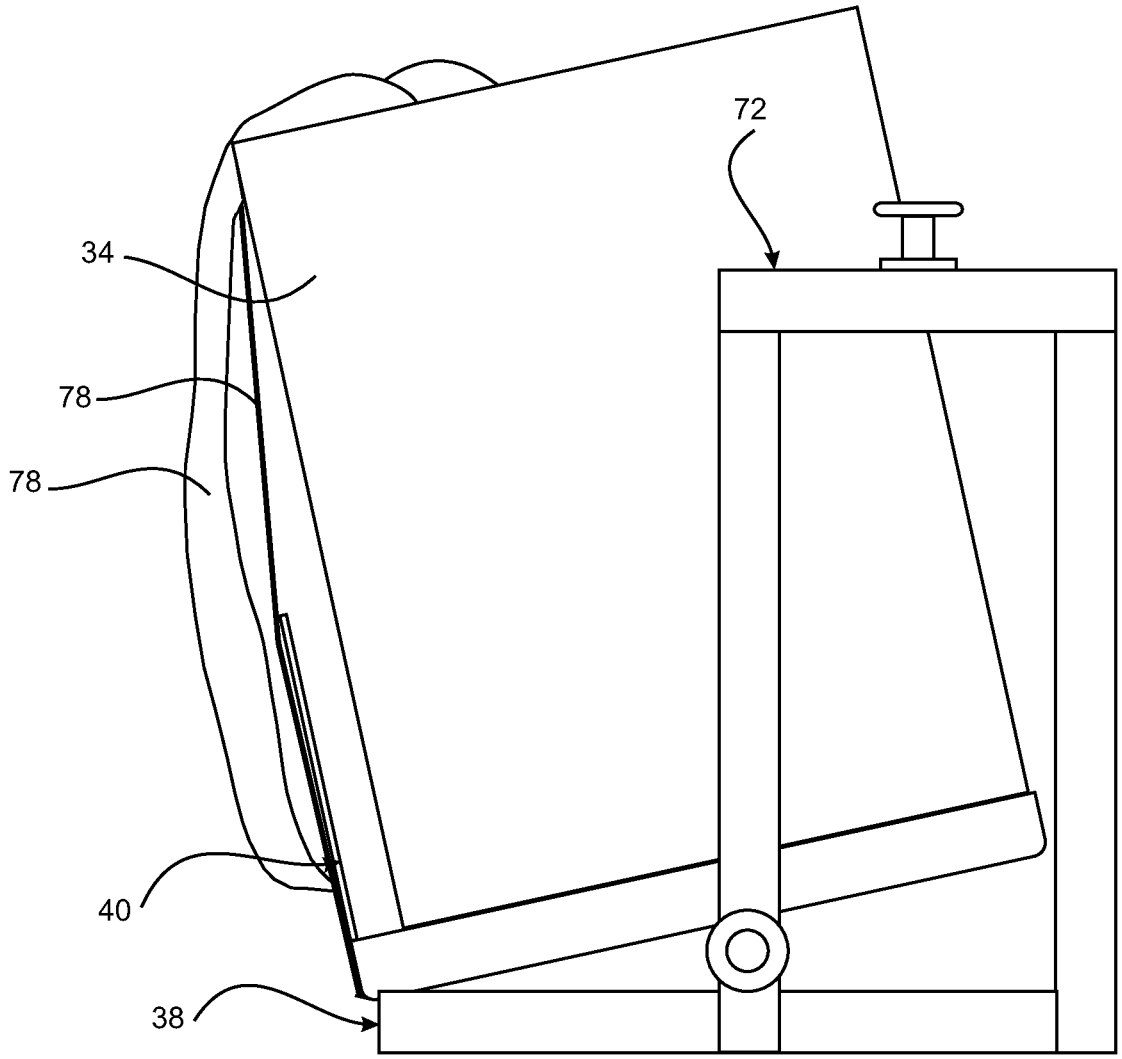
FIG. 5 is an end view of the frame shown in FIG. 4 and depicting a box of incendiaries supported in one possible position on the frame.
Figure 6:
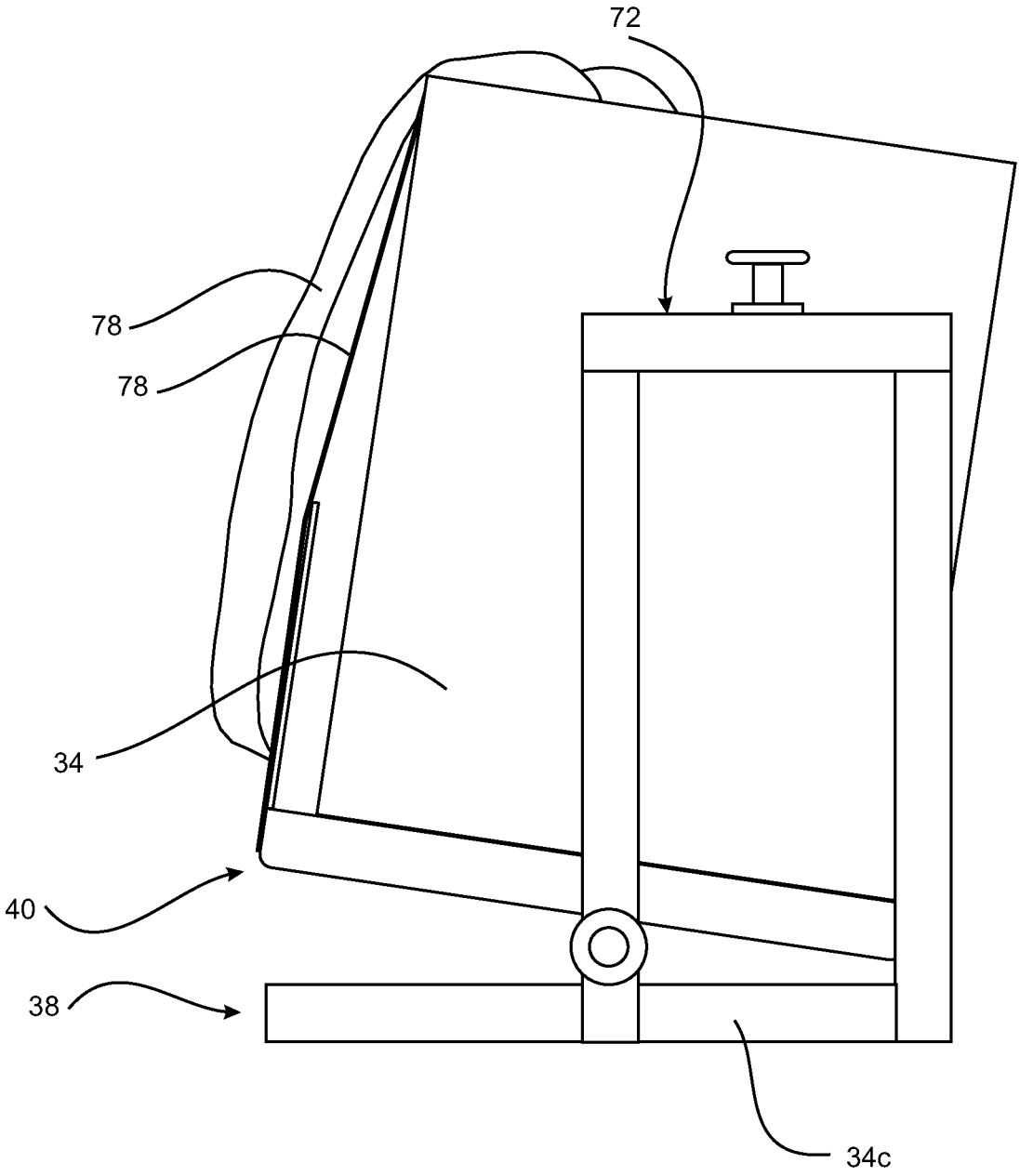
FIG. 6 is an end view of the frame of the incendiary machine showing a box of incendiaries supported in a second different location.

As is best seen in FIG. 4, the tray 40 is pivotally coupled to the frame 32 by a pivot bar 46 which runs centrally beneath the tray 40 and is coupled at opposite ends to the frame 32 as well as being coupled to the platform 40 by three spaced apart brackets 48. With reference to FIGS. 1 and 3, the coupling of the tray 40 to the frame 32 enables the tray 40 to pivot or swing forward or backward. This is shown more specifically in FIGS. 5 and 6. FIG. 5 illustrates the platform 40 supporting the box 34 where the platform 40 and thus the box 34 is pivoted backwards and FIG. 6 which shows the tray 40 and box 34 pivoted in a forward direction. The pivoting tray 40 enables the belt 14 to be fed to the feed and dispensing system 12 with minimal twist and/or bend. This will be explained in greater detail below.

The upper portion 36 is a rectangular frame comprising bars 50*a*, 50*b*, 50*c* (shown in FIG. 4) and 50*d* (best seen in FIG. 3). The bar 50*d* is parallel to and opposite the bar 50*b* and extends between the bars 50*a* and 50*c*. Frame 36 also comprises a cross bar 52 that extends between bars 50*a* and 50*c*, and a cross bar 54 which extends between the bars 50*d* and 52. A tube 56 depends from and is connected to the frame 32 between the bars 50*b* and cross bar 52. An end of the tube 56 that lies adjacent the housing 30 is provided with a radially extending flange 60 which seats beneath a hole in the housing 30 which is aligned with the chute 28. A transition frame portion 62 couples, and extends perpendicularly between the frame portions 36 and 38. The transition frame portion 62 includes a bar 64*a* which is common to or shared with the frame portion 38 and in which one end of the pivot bar 46 is journalled. The frame portion 38 also includes bars 64*b*, 64*c* and 64*d* which together with the bar 64*a* are joined together to form a rectangular shape. The bar 64*c* is parallel to and opposite the bar 64*a*. An end of the pivot bar 46 opposite the bar 44*a* is journalled in the bar 46*c*.

A pair of curved bars 66*a* and 66*b* lie on opposite sides of the frame 32 and extend between the frame portions 36 and 38. The bar 66*a* extends from an end of the bar 64*b* to the bar 50*a* at a location in board of the cross bar 52. The curved bar 66*b* extends from an end of the bar 64*b* to the bar 50*c* in board of the cross bar 52. The curved bars 66*a* and 66*b* are of a shape arranged to seat in a door way of a Bell 206 Jet Ranger or Bell 206L Long Ranger aircraft.

However, when the machine 10 is being used in a different type of aircraft such a Eurocopter AS350 or other helicopter with a flat floor in order to ensure proper seating of the frame 32 an adapter plate 68 (see FIG. 3) which is of a generally rectangular configuration is attached on one side of the frame 32 and lying over a corresponding curved bar 66. The plate 68 is detachably coupled to the frame 32 by pip pins 70.

An upstanding and bent handling frame portion 72 is attached to the frame portion 38 from a location adjacent the bar 64*c*. The frame 72 initially extends generally upwardly in a direction of the tray 40 and thereafter extends at an obtuse angle away from the tray 40.

A drop tube 74 is demountably coupled by a pin 76 to the tube 56 and extends downwardly to a location outside of the aircraft which carries the machine 10.

The box 34 is held on the tray 40 by a strap 78 and holds a drum or roller on which the belt 14 is wound. It is envisaged that the belt 14 is a continuous belt wound about the roller and may comprise for example 1000 end to end joined incendiary capsules 16.

With reference to FIGS. 1-3, 6 and 7, the feed and dispensing system 12 comprises a carousel 80 having an outer rim 82 in which is formed a plurality of recesses 84 for receiving respective capsules 16. The outer rim 82 is connected by a plurality of spokes 86 to a central hub 88 which couples to a shaft that passes through a fire proof plate 90 (typically a plate made from a metal). The plate 90 in effect divides the housing 30 into a front portion in which the carousel 80 and the pump 22 reside, and a rear portion which, as described later, houses an ethylene glycol tank, a water tank, and electronic components of the control system. Respective longitudinal slots 92 are formed in the outer rim 82 between adjacent recesses 84.

The feed and dispensing system 12 also includes a cutting blade 94 which is able to separate individual capsules 16 from the belt 14 in the region 18 prior to the separated capsules 16 entering the chute 28. The blade 94 is eccentrically supported on a rotating wheel 96 so that as the wheel 96 rotates the blade 94 undergoes a reciprocating up and down motion. The wheel 96 is located so that the cutting blade 94 when at the top of its reciprocating motion coincides with the location of and extends into a slot 92 and thereby cuts a leading capsule 16 from the belt 14. As explained herein after, a belt and cog system ensures synchronisation between the rotation of the carousel 80 and the wheel 96 and thus the reciprocation of the blade 94 to ensure that the blade 94 reaches a top of its travel when in alignment with a slot 92.

With reference to FIGS. 2 and 3, an automatic feeder 98 enables the belt 14 to be automatically fed onto the carousel 80. The automatic feeder 98 comprises a channel 100 and a biased plate 110. The channel 100 extends from an opening 102 in the housing 30 to the carousel 80 and comprises two parallel spaced apart curved plates 104*a* and 104*b* between which the incendiary belt 14 is guided toward the carousel 90. The channel 100 has a mouth 106 adjacent the outer rim 82 of the carousel 90. The biased plate 110 lies beneath the mouth 106 and near the lower curved plate 104*b*. The plate 110 has a wave or elongated "S" shaped profile. An upper or upstream end 114 of plate 110 is radially spaced from mouth 106 by a distance no less than, and preferably greater than, the radial spacing of the mouth 106 and in particular the curved plate 104*b* of the mouth 106 from the carousel 80. This ensures that as the belt 14 travels through the channel 100 and onto the plate 110, a leading end of the belt 14 can not catch on the end 114. A portion 116 of the plate 110 downstream of the end 114 is spaced radially closer to, and follows the contour of, the carousel 80. The plate 110 has a downstream end 117 that is located between the carousel 80 and a separate guide plate 119. Guide plate 119 follows the contour of the carousel 80 and has an integral extension 121 which forms or defines the chute 28. An opposite end 123 of the guide plate 119 is bent away from the carouse 80 to provide room for the plate 110 to move radially backwards and forwards in response to the passage of the belt 14 and action of the bias on the plate 110.

The plate 110 is biased radially toward carousel 80 by a spring (not shown) which extends about a portion of a circular bar 118 which in turn is coupled to a slide block 120. The bar 118 passes through a lug 122 and is formed with a flange 124 at an end distant the slide block 120. The spring which biases the shoe 110 is retained between the lug 122 and the flange 124. The slide block 120 is able to slide linearly in a track (not shown) which also extends in the radial direction of a carousel 80.

Priming system 20 comprises the pump 22 and the injection device 24 which may take the form of a hypodermic needle. Injection device 24 is mounted on the same rotating wheel 96 as the cutting blade 94. The pump 22 pumps glycol from a glycol tank held within the housing 30 on a side of the plate 90 opposite the pump 22 to the injection device 94. To this end, a first conduit 1 provides fluid communication between the pump 22 and glycol tank, while a second conduit 128 provides fluid communication with the injection device 24. The injection device 24 is located relative to the blade 94 so that when the blade 94 is received within a slot 92 to cut the leading capsule 16 from the belt 14, the injection device 24 pierces the separated capsule 16 to allow an injection of ethylene glycol into the capsule.

Figure 9:
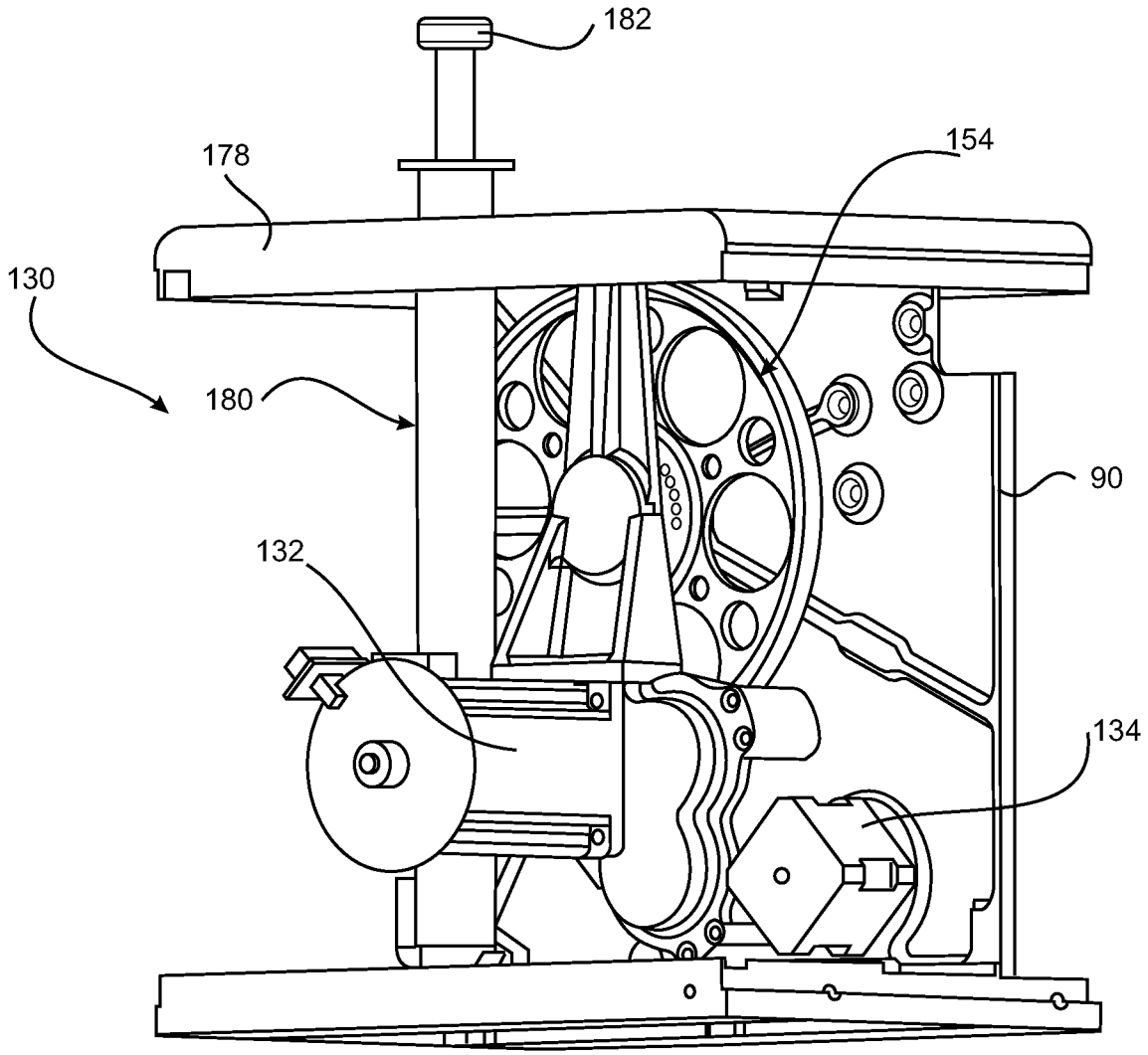
FIG. 9 is a representation of a drive system of a machine.
Figures 10, 11:
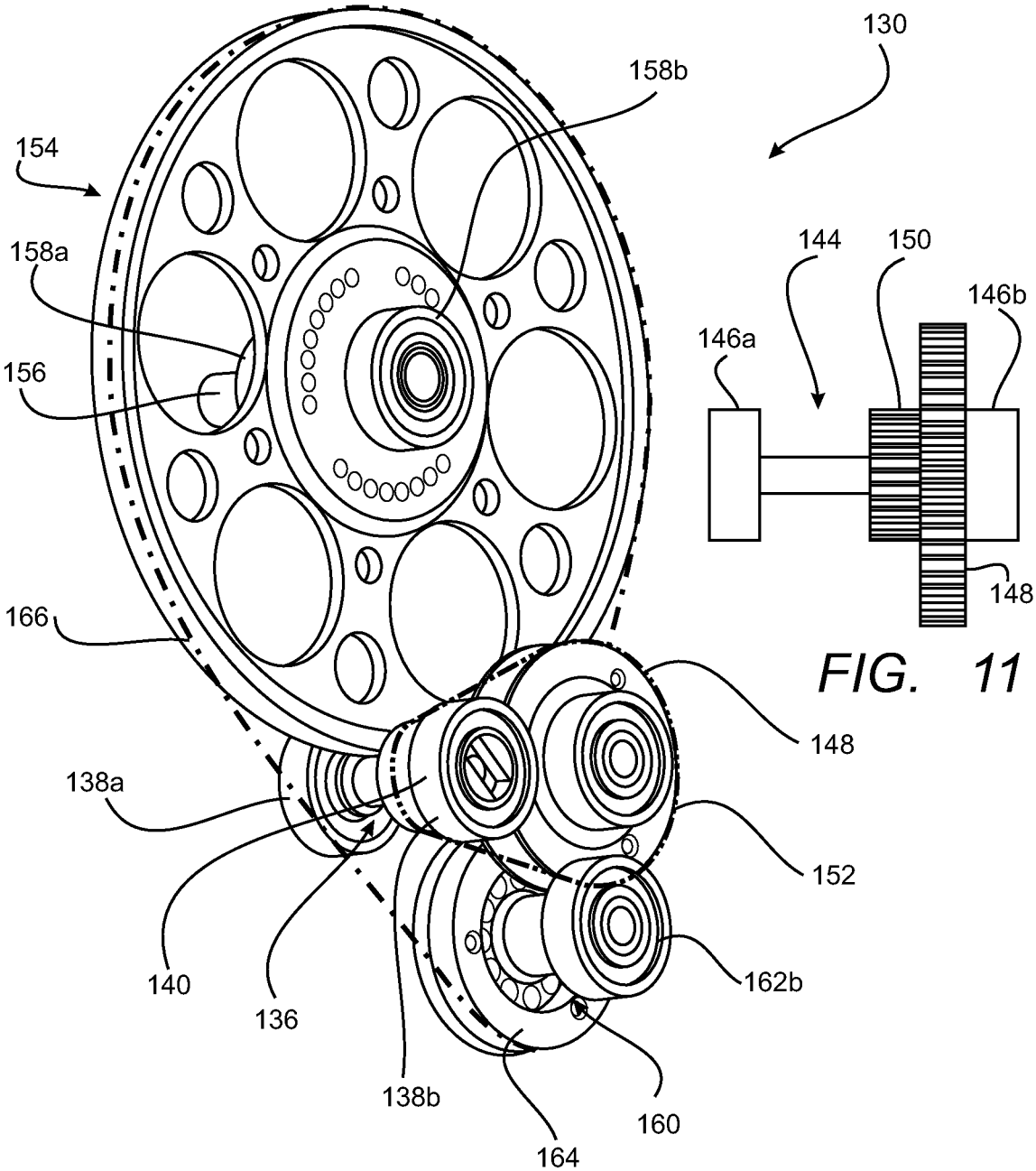
FIG. 10 is a representation of an arrangement of belts and cogs incorporated in the drive system.
FIG. 11 is a representation of one set of cogs incorporated in the drive system.

FIGS. 9 and 10 illustrate a drive system 130 for the machine 10. The drive system 130 comprises a first motor 132 which drives the feed and dispensing system 12, and a second motor 134 which drives or operates the pump 22. The control system 26 independently operates the motors 132 and 134.

Motor 132 drives a main drive shaft 136 which is supported at spaced apart locations by bearings 138*a* and 138*b*. A cog 140 is mounted on the drive shaft 136 between the bearings 138*a* and 138*b*. A second shaft 144 (see FIGS. 10 and 11) is supported at opposite ends by bearings 146*a* and 146*b* and has mounted thereon, cogs 148 and 150. In FIG. 10, the cog 148 is clearly visible however the cog 150 is behind the cog 148 and therefore not visible in FIG. 10 but shown in FIG. 11. An endless drive toothed belt 152 represented by phantom line, extends about and engages the cogs 140 and 148. Thus, drive or torque imparted by the motor 132 to the shaft 136 is in turn imparted to the shaft 144. The cogs 140 and 148 have a gear ratio of 1:2 so that two turns of the cog 140 produces a single turn of the cog 148. A relatively large diameter cog 154 is provided with a shaft 156 to which the hub 88 of the carousel 80 is connected on an opposite side of the plate 90. Respective bearings 158*a* and 158*b* support the shaft 156 on opposite sides of the cog 154. An idler shaft 160 is supported at opposite ends by respective bearings, only one of which 162*b* is illustrated. An idler cog 164 is mounted on the shaft 160 between its respective bearings.

An endless toothed belt 166 shown in phantom line in FIG. 10 engages the cogs 150, 154, and 164. In particular, the belt 166 engages a left hand side of the cog 150 when viewed in FIG. 10, i.e. the belt 166 engages a side of the cog 150 which at any one time is located between the shafts 136 and 144. By virtue of this arrangement, remembering that the shaft 144 is driven by the shaft 136, the cogs 144 and 154 rotate in opposite directions. The wheel 96 upon which both the cutting blade 94 and the injection device 24 are mounted is attached to the shaft 136. Accordingly as the carousel 80 is connected to the cog 154 via the shaft 156, the carousel 80 and the wheel 96 rotate in opposite directions. Further, in this particular embodiment, there is an eight to one gear ratio between the cog 154 and the cog 164. As a consequence of this, there is in total a 1:16 gear ratio between the cog 140 and the cog 154. This means that the shaft 136 completes sixteen revolutions or rotations for every one revolution or rotation of the shaft 156. Accordingly the cutting blade 94 and injection device 26 reciprocate up and down sixteen times for every single rotation of the carousel 80. There are also sixteen recesses 82 in the carousel 80. Thus for every single rotation or revolution of the carousel 80, sixteen capsules 16 can be separated from the belt 14, initiated and dropped from the machine 10.

Figure 7:
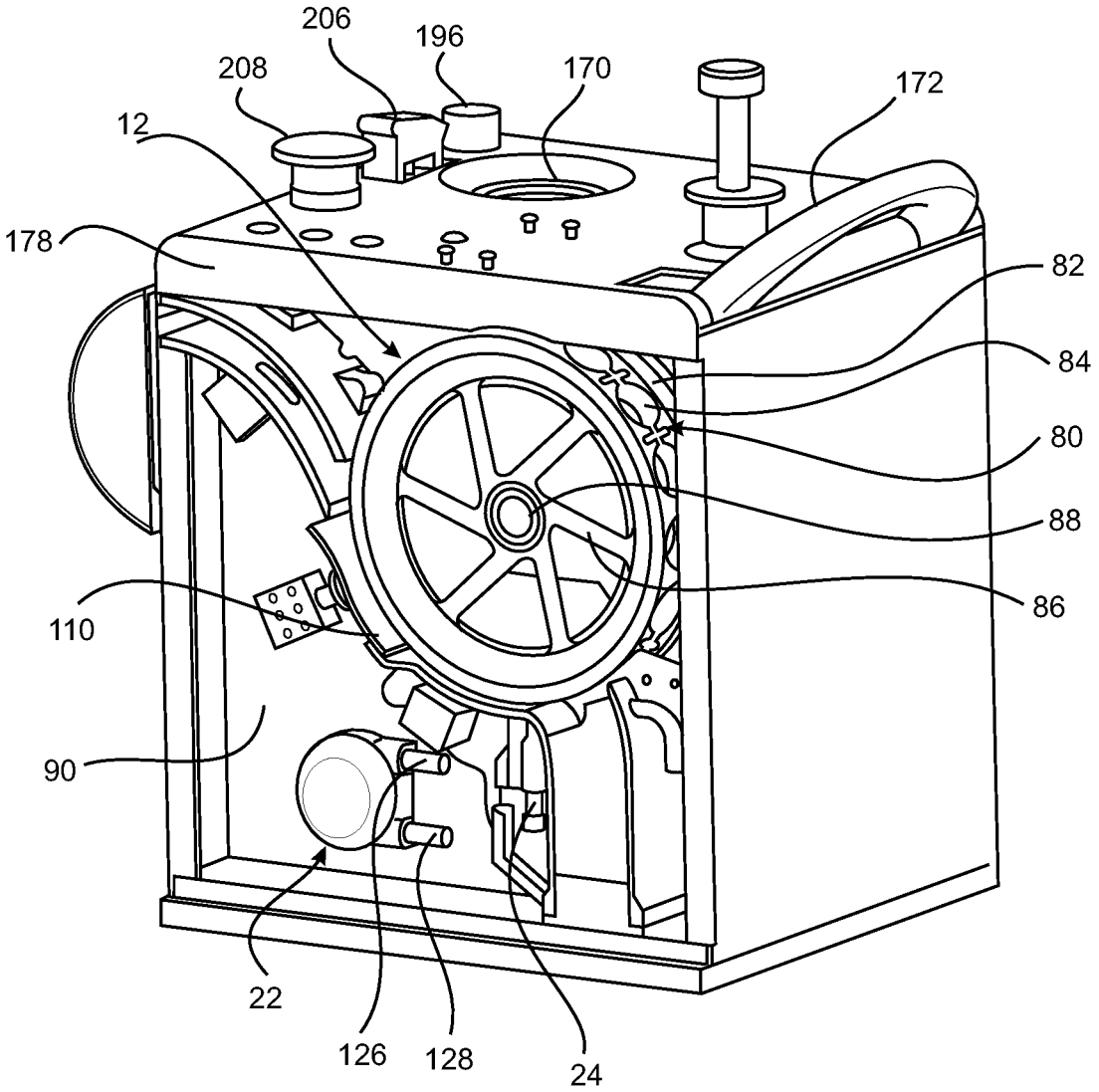
FIG. 7 is schematic representation of a portion of the machine viewed from a first angle.
Figure 8:
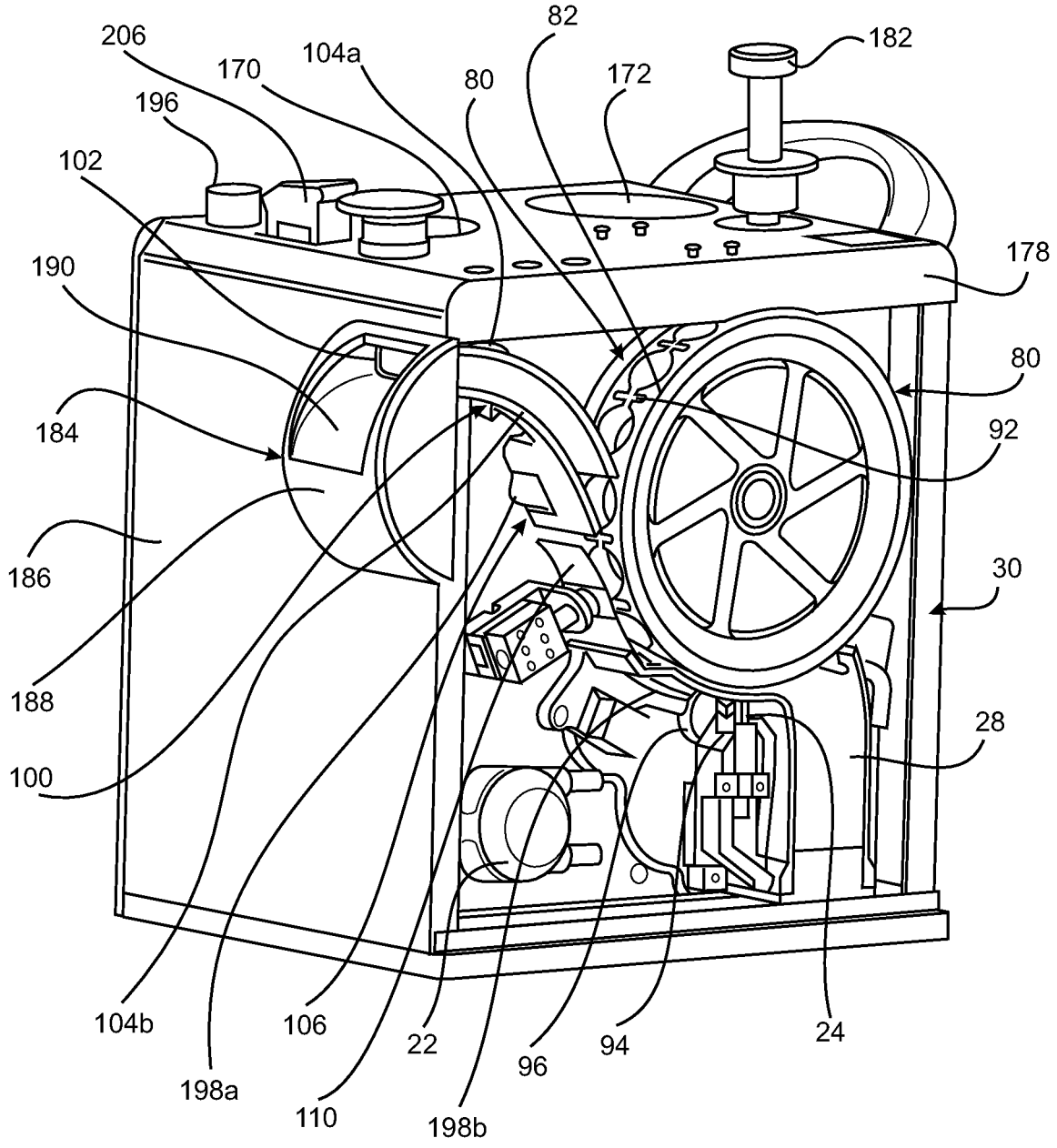
FIG. 8 is a representation of the machine shown in FIG. 7 but at a different angle.

As previously mentioned, the machine 10 has a tank for storing a supply of ethylene glycol and a tank for holding a supply of water. Although the tanks are not shown in the accompanying drawings, openings 170 and 172 for the glycol and water tanks respectively are depicted in FIGS. 7 and 8, and removable caps 174 and 176 for opening and sealing the openings 170 and 172 are depicted in FIG. 1. The openings 170 and 172 are formed on an upper planar surface 178 of the housing 30 and lead to corresponding tanks which are disposed in the housing 30 on a side of the plate 90 opposite the carousel 80. A hand pump 180 is also provided in the machine 10 to enable pumping of water from the water tank into other areas of the machine 10, and in particular into the housing 30 on the side of the plate 90 having the carousel 80. The hand pump 180 is operated in the event of a fire occurring within the housing 30. The pump 180 has a handle 182 that projects upwardly from the surface 178 of the housing 30 and is preprimed so that the pump 180 will pump water into the housing 30 immediately upon depression of the handle 182.

A belt insertion guide 184 is formed on a side wall 186 of the housing 30 to assist in guiding the belt 14 of incendiaries 16 into the automatic feeder 98 and in particular the channel 100. The guide 184 is in the form of a hemispherical block where an outer circumferential surface 188 is relieved or recessed to have a progressively reduced radius for an arc of approximately 90° thereby forming a rebated surface 190 which leads to the opening 102.

The housing 30 is also provided with a door 192 shown best in FIG. 1 which can be opened and closed to access the internals of the machine 10. The door 192 is provided with a glass or other fire resistant and transparent panel 194 to facilitate visual inspection of the operation of the machine 10 and in particular the feeding, priming and dispensing of the capsules 16.

The control system 26 comprises a processor (not shown) which controls the motors 132 and 134 and is responsive to inputs from various sensors and switches of the machine 10. Power for operation of the control system 26 and the motors 132 and 134 is provided by an external power supply, typically from the aircraft on which the machine 10 is carried. A power supply socket 196 is provided on the top surface 178 of the housing 30 to facilitate connection with the power supply.

The sensors incorporated in the control system 26 include level sensors (not shown) for the glycol tank and water tank; a door sensor (not shown) which senses whether the door 192 is opened or shut; a torque or load sensor (not shown) for the motor 132; and a pair of incendiary belt sensors 19*a* and 198*b* (see FIGS. 3 and 8). The sensor 198*a* is located near the mouth 106 of the channel 100 while the sensor 198*b* is located on the plate 119 between the shoe 110 and the chute 28. Some of the buttons and switches for the controller 26 are mounted on the top surface 178 of the housing 30, while others are provided on a hand held pendant 200 which is coupled by a cable 202 and socket 204 to communicate with the processor of the controller 26.

A master power switch 206 is in the form of an aviation two way switch. This provides power to the controller 26 and motors 132 and 134 upon activation, assuming of course that a cable for supplying power is connected via the socket 196 to the machine 10. On activation of the master switch 206, the pendant 200 will light, indicating that the machine 10 is powered. Directly below the master power switch 208 there is provided a glycol stop switch 208. When the switch 208 is depressed, the feed and dispensing system 12, and the priming system 20 are immediately stopped rendering the capsules 16 harmless. If the glycol stop switch 208 has been depressed, the machine 10 will not operate until the switch 208 is reset. The switch 208 is a rotary type push switch and in order to,reset must be turned until it pops back up.

Beneath the glycol switch 208 there is provided input devices in the form of a load button 210, an unload button 212, and in between a prime button 214 (see FIG. 1). Pressing or activating the load button 210 will drawn an incendiary belt 14 toward the injection device 24 without activating the glycol pump 22. This is useful for travelling to an operation, or during pre-flight checks. The button 210 is configured to only be active if the glycol stop button 208 has been activated and the pendant 200 is blank (i.e. is not illuminated).

The unload button 212 when activated enables the incendiary belt 14 to be extracted from the machine 10. Typically the unload button 212 will be activated when a mission or operation is complete, or in between drop zones. The unload button 212 is only active if the glycol stop switch 208 is activated, the remote pendant 200 is blank, and the belt 14 is of sufficient length so that its presence is sensed by the sensor 198*a*. Prime button 214 is located between the buttons 210 and 212 and when pressed operates the pump motor 134 and thus the pump 22 to pump ethylene glycol to the injection device 24. The prime button 214 is depressed to reprime the pump 22 and the injection device 24 in the event that they have been drained of glycol. When these have been primed, and the button 214 is operated, a flow of ethylene glycol should be evident from the tip of the injection device 24.

Figure 12:
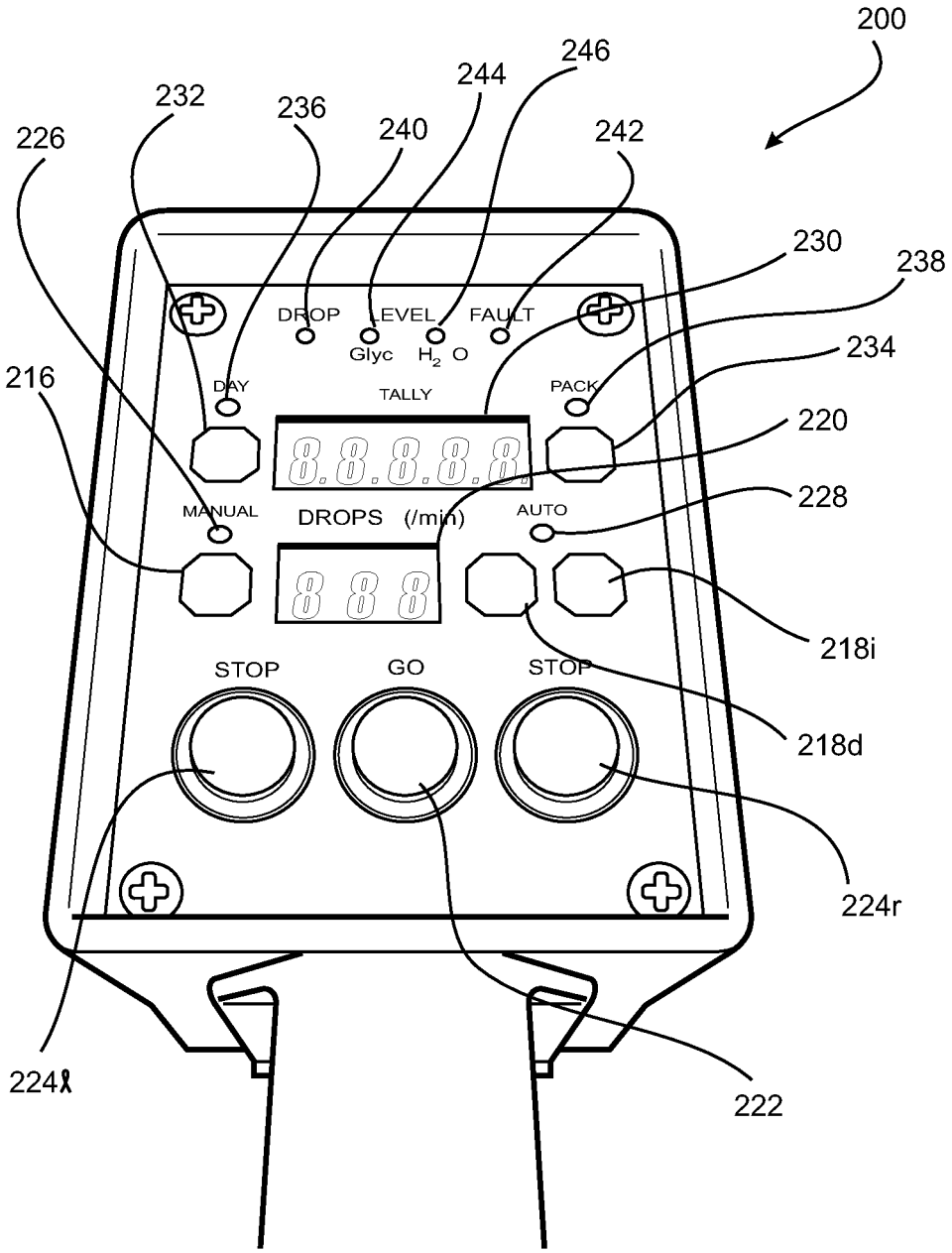
FIG. 12 is a representation of a hand held pendant incorporated in the machine.

FIG. 12 illustrates the pendant 200 which is electrically coupled with the control system and provide with a user interface to provide input to the control system as well as display status information regarding the machine 10. The interface comprises buttons and/or switches enabling a user to switch the machine between a manual mode by depressing a manual button 216 on the pendant 200, or alternately an automatic mode by depression of the drop rate buttons 218*d* and 218*i*. Pressing the automated switches 218*d* or 218*i* enables a user to increase or decrease the drop rate (ie, number of incendiary capsules 16 dropped by the machine per minute). Depressing the button 218*d* decreases the drop rate while depressing the button 218*i* increases the drop rate. The selected drop rate is displayed on a drop rate display 220. The controller 26 may be programmed to vary the drop rate in units of more than one for each depression of the buttons 218*d* or 218*i*. For example, the drop rate may be increased or decreased by, say, two or five capsules per minute for each depression of the buttons 218*d* or 218*i*.

When the manual button 216 is depressed, the machine 10 will drop one primed incendiary capsule 16 every time a GO button 222 on the pendant 200 is pressed. The pendant 200 is provided with two stop buttons 224*r* or 224*l* (hereinafter referred to in general as "stop buttons 224"). The stop button 224*r* is on the right hand side of the pendant 200, while the stop button 224*l* is on the left hand side of the pendant 200, with the GO button 222 between the two stop buttons. The controller 26 is programmed to stop operation of the machine 10 to the extent that it ceases to drop capsules 16 when either of the stop buttons 224 is pressed. Assuming that either of the buttons 218*i*,218*d* is pressed to select a desired drop rate, pressing the GO button will activate the machine 10 to drop primed incendiary capsules 16 at the designated drop rate. If it is desired to switch to manual mode, one of the stop buttons 224 is depressed and the manual button 216 is depressed. Now upon each depression the GO button 220 a single capsule is primed, cut from the belt 14 and dropped. An indicator light 226 is associated with the manual button 216, and an indicator light 228 is associated with the drop rate buttons 218*i* and 218*d*. The lights 226 and 228 illuminate each time the associated buttons are depressed.

A tally display 230 is provided on the pendant 200 to provide an indication of the number of incendiary capsules dropped. The tally display 230 is associated with a Day button 232 and a Pack button 234. Each of the buttons 232 and 234 has a respective associated indicator light 236 and 238. By pressing the Day button 232, the tally display 230 will display a running total of the incendiary capsules dropped before the day or mission. When a user pushes the Day button 232, the associated indicator light 236 is illuminated. Alternately, by pressing the Pack button 234, the tally display 230 will provide a display of the number of incendiary capsules dropped from the current incendiary capsule belt 14. Pressing of the Pack button 234 is acknowledged or indicated by illumination of the indicator lamp 238.

The tally display 230 is also coupled with the control system 26 to display fault messages to a user. For example, as previously described, the machine 10 includes a sensor for sensing the torque or load on the motor 132. If this torque or load is at abnormal levels, the machine 10 is stopped and a message "JAM" is displayed in the tally display 230. The pendant 200 is, also provided with a drop indicator lamp 240, a fault indicator lamp 242, a glycol level indicator lamp 244 and a water level indicator lamp 246. The drop indicator lamp 240 illuminates whenever an incendiary capsule is dropped. The level indicator lamps 224 and 246 illuminate whenever the respective glycol or water tanks are less than one quarter full.

The fault indicator lamp 242 is illuminated when the control system 26 and associated sensors detect a fault in the machine 10. The nature of the fault is displayed in the tally display 230.

Figure 13:
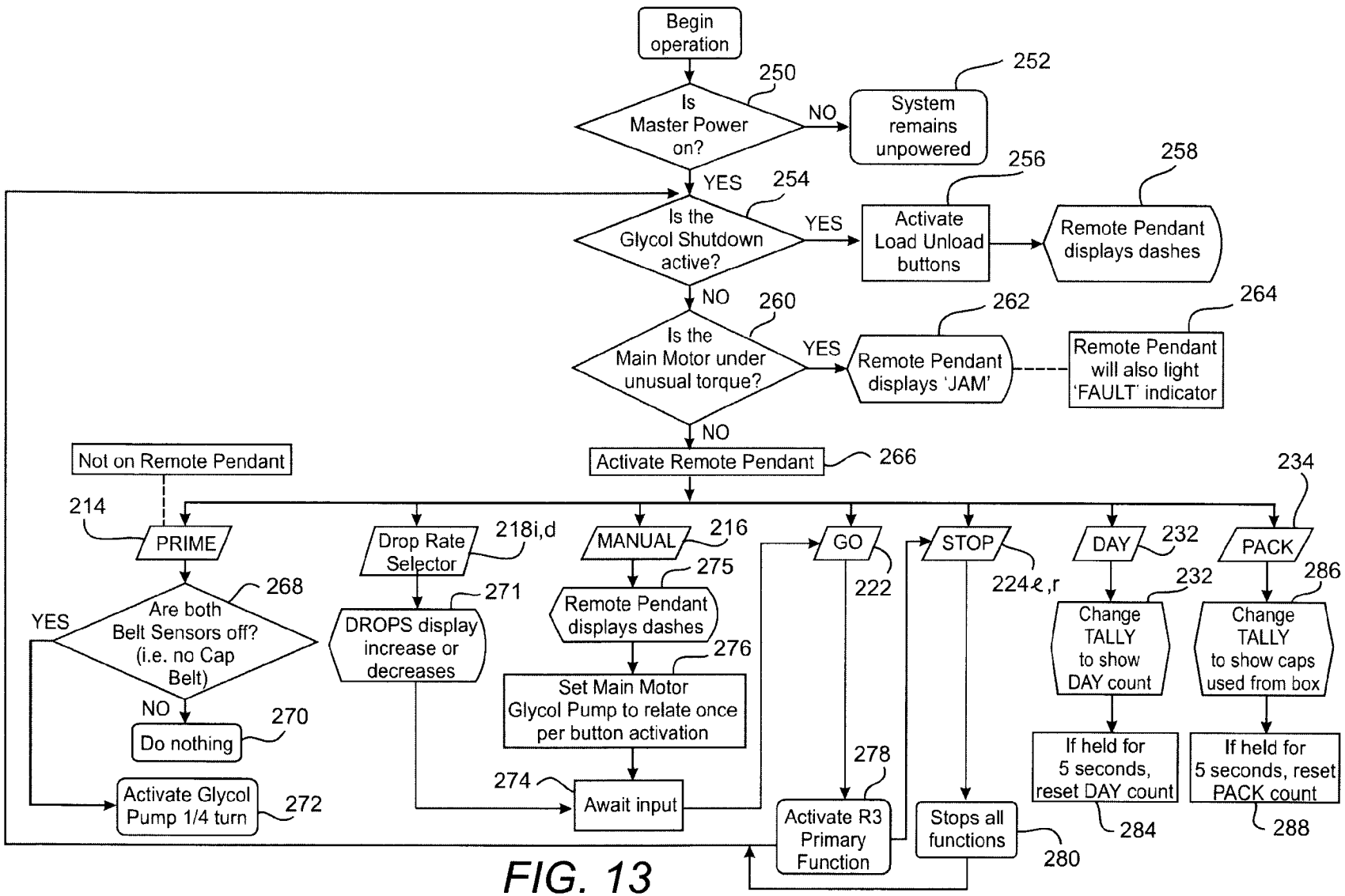
FIG. 13 is a graphical representation of the operation of the machine.

FIG. 13 graphically depicts the operation of the machine 10. In the diagram, box 250 represents the state of the master switch 206. If the master switch 206 is OFF, then the system 10 remains unpowered and no incendiary capsules 16 can be dispensed. If the master switch 206 is ON, the control system conducts an operation to determine whether or not the glycol stop button 208 has been activated. In the event that the glycol stop button 208 has been activated, the controller 26 enters a state 256 enabling the activation of either of the load button 210 or the unload button 212. As previously mentioned, pressing the load button enables the incendiary belt 14 to be drawn towards the injection device 24 without the glycol pump 22 being activated. Pressing the unload button 212 enables the incendiary belt 14 to be extracted from the machine 10 safely. The depression of the glycol button 208 also causes the controller 26 to conduct an action 258 where it operates the tally display 230 to display a specific display or symbol such as a dash for each character position on the tally display 230, thereby providing an indication on the pendant 200 that the glycol button 208 has been depressed.

If the glycol stop button 208 has not been depressed, then the control system conducts an operation 206 to determine whether or not the motor 132 is under an unusual torque or load. If this is the case, then the control system 26 conducts an operation 262 to cause the tally display 230 to display the message "JAM", and an operation 264 to cause the fault lamp 242 on the pendant 200 to illuminate.

If there is no unusual torque or load on the motor 132, then the pendant 200 enters an activated state 266 in which the buttons and switches on the pendant 200 may be operated and acted upon by the controller 26 and machine 10. In addition, the prime button 214 which is located on the upper surface 178 of the housing 30 also becomes active. Upon pressing the prime button 214, the control system 26 performs an interrogation step 268 in which it interrogates the sensors 198*a* and 198*b* to determine whether or not an incendiary belt 14 is loaded into the machine 10. If not, the control system 26 enters a state 270 in which it prevents the priming system 20 from priming the pump 22 and the injection device 24. However, if it is determined that there is a belt 14 in the machine 10, the control system 26 enters a state 272 where it enables the priming system 20 to operate the pump 22 for a limited duration, for example for one quarter of a turn of the pump 22, in order to prime the pump 22 and the injection device 24. The prime button 214 may be held down to effect multiple consecutive quarter turns of the pump in order to fully prime the pump 22 and the injection device 24. This is indicated or can be verified by the visual ejection of glycol from the injection device 24.

By depressing the drop rate buttons 218*i* and 218*d*, the control system 26 enters a state 271 in which it operates the drop display 220 to display the selected drop rate for the incendiaries 16. The control system also enters the drop rate into a register 274.

On depressing the manual button 216, the control system 26 at step 275 operates the drop rate display 220 to display a series of dashes in each character location of the display 220. Additionally, the controller 26 conducts an operation 276 in which it sets the feed and dispensing system 12 and the priming system 20 to prime and separate one capsule 16 from the belt 14 for each depression of the GO button 222. This operating procedure for the feed and dispensing system 12 and the priming system 20 is also logged in the register 274. The register 274 will either hold the desired drop rate of capsule, or hold an indication that capsules are to be dropped at a rate of one for each depression of the GO button 222.

The register 274 is linked with the GO button 222 so that when the GO button 222 is depressed, the control system 26 enters a state 278 where actions stored in register 274 are acted upon by the machine 10. Thus, if the machine 10 is in the automatic mode where capsules are dropped at a rate set by the drop rate buttons 218*i* and 218*d*, the machine 10 operates to dispense primed capsules 16 at the selected drop rate. However if the machine 10 is in the manual mode, then it operates to dispense one primed capsule 16 for each depression of the GO button 222.

Upon depression of either of the stop buttons 224*i* or 224*r*, the machine enters a stop state 280 where the control system 26 functions to complete the current dispensing cycle and then immediately stops operation of the feed and dispensing system 12 and the priming system 20 to thereby prevent dispensing of any further capsules 16.

When depressing the Day button 232, the control system 26 drives the tally display 230 to depict the number of capsules 16 dispensed on that day or for a particular mission. This tally is a tally of drops since the previously reset of the day count. Holding the Day button in a depressed state for five seconds causes the controller at step 284 to clear the day count shown in the tally display 230.

On pressing the Pack button 234 the controller 26 performs an operation 286 where it drives the tally display 230 to display the number of capsules 16 used from the box of capsules 34. Holding down the Pack button 234 for an extended period of time such as five seconds causes the controller 26 to perform an operation 288 where it clears or resets the PACK count.

In one example of use of the machine 10, the machine 10 may be fitted to a helicopter with the housing 10 mounted on the frame portion 36, the box 34 of capsules supported on the frame portion 38, and the frame 32 fixed to the helicopter by use of one or more straps with a machine 10 orientated so that when the drop tube 74 is attached to the tube 56 on the frame 32, the drop tube depends vertically down from a location outside of the helicopter. Box 34 is held on the tray 40 by the strap 78. The glycol and water tanks are filled by removal of the corresponding tank caps 174 and 176. Machine 10 is supplied with power from the helicopter by coupling of a power cable from a power supply of the helicopter to the power supply socket 196. When the helicopter is airborne an operator may then turn on the machine 10 using the master switch 206.

Prior to loading machine 10 with belt 14, the priming system 20 may itself be primed by pressing of the prime button 214 to ensure that the pump 22 and the injection device 24 are filled with glycol prior to operation of the machine 10 to dispense capsules 16. To initially load the belt 14 into the machine 10, an operator pushes a leading end of the belt 14 through the opening 102 and the channel 100 to the automatic feeder 110. Assuming the carousel 80 is turning, the auto feeder 98 operates to bias a leading capsule 16 on the belt 14 into an adjacent recess 82 of the carousel 80. As the belt is consumed, it unrolls from different locations on the roller held within the box 34. Due to the pivotal nature of the tray 40, the tray and box are able to tilt to minimise the twist in the belt 14 as well as the angle at which the belt extends from the opening 102 to the point of departure from the roller on which the belt 14 is wound.

An operator may push the drop rate buttons 218*i* and 218*d* to select a drop rate of capsules. On pressing the GO button the motor 132 will be operated and controlled by the control system 26 to rotate the carousel 80 at the required speed in order to provide the selected drop rate. If however the manual button 216 has been pressed then only a single capsule will be cut, primed and dropped from each pressing of the GO button 222. However, the control system 26 is also sensitive to the inputs of the drop sensors 198*a* and 198*b*. In the event that no capsule is sensed by the sensor 198*b*, the controller 26 will enable the motor 132 to operate to rotate the carousel 80 and indeed also rotate the wheel 96 causing reciprocating motion of the injection device 24 and the cutter 94, but it will not operate the motor 134 and therefore no glycol will be pumped by the priming system 20.

Figure 14:
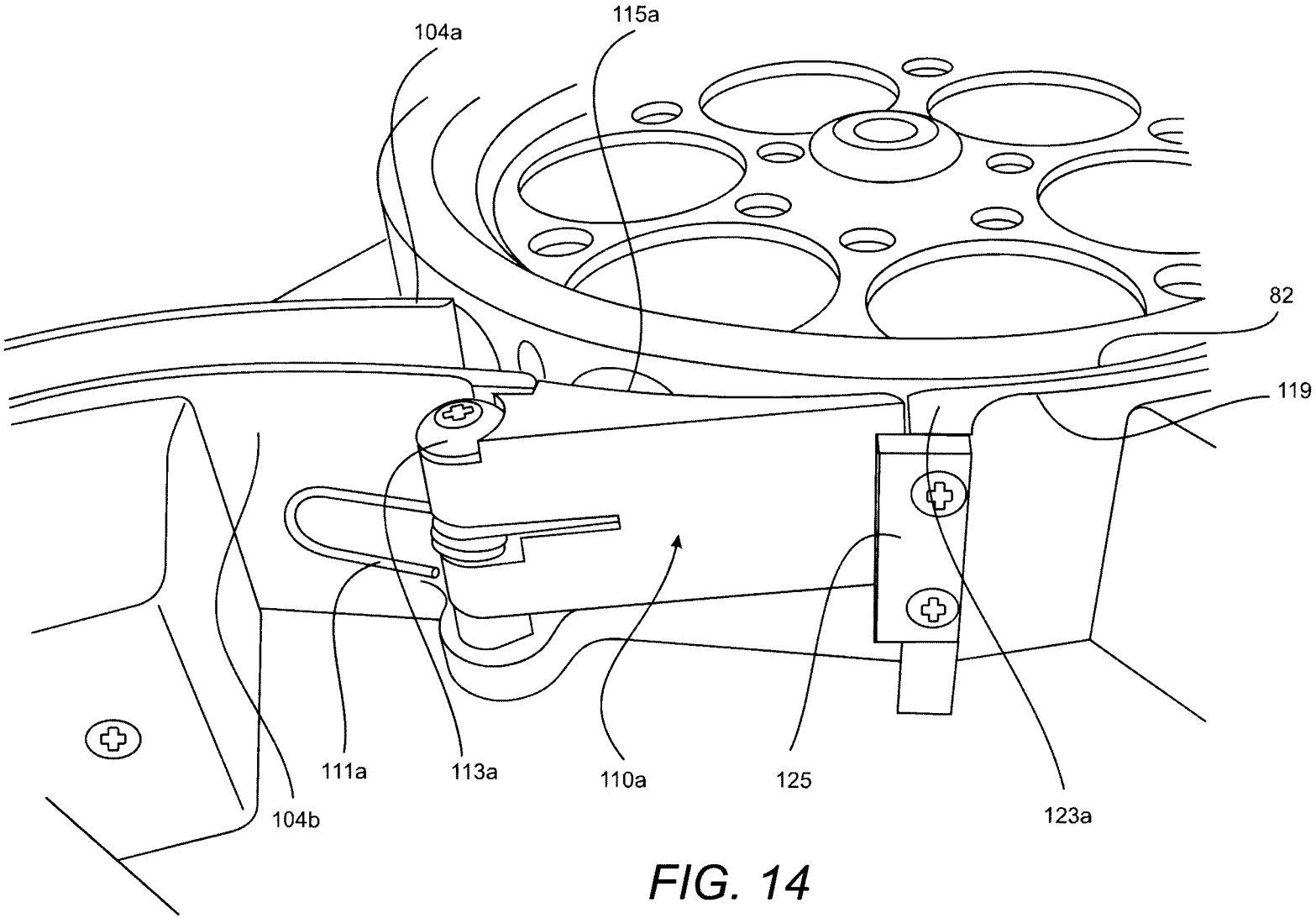
FIG. 14 is a representation of a portion of a second embodiment of the machine; and, FIG. 15 is a representation of the second embodiment of the machine.

Now that an embodiment of the invention has been described in detail it will be obvious to those of ordinary shill in the art that numerous modifications and variations may be made without departing form the basic inventive concepts. For example the plate 110 for biasing capsules in the recesses 84 is,shown as separate from the channel and movable linearly in a radial direction referenced to the carousel 80. However in one variation depicted in FIG. 14 a modified plate 110*a* may be used to perform the same function. The plate 110*a* is pivotally coupled to the fire proof plate 90 immediately beneath and adjacent curved plate 104*b* to in effect form a continuous extension to plate 104*b*. A spring 111*a* biases the plate 110*a* to pivot in a direction toward the rim 82 of carousel 80 about a screw 113*ba* which also mounts the plate 110*a* to the fireproof plate 90. An upper surface 115*a* of plate 110*a* is concavely curved to substantially match the curvature of the outer rim 82. Downstream end 117*a* of plate 110*a* lies adjacent an end 123*a* of modified guide plate 119*a*. Guide plate 119*a* is modified in relation to guide plate 119 of the first described embodiment by a reshaping of its end 123*a* which now substantially follows the curvature of the rime 82 rather than being bent away from carousel 80 as depicted in FIG. 3. A stop 125*a* is attached to an underside of plate 119*a* at end 123*a* to limit the pivoting motion of plate 110*a*.

Figure 15:
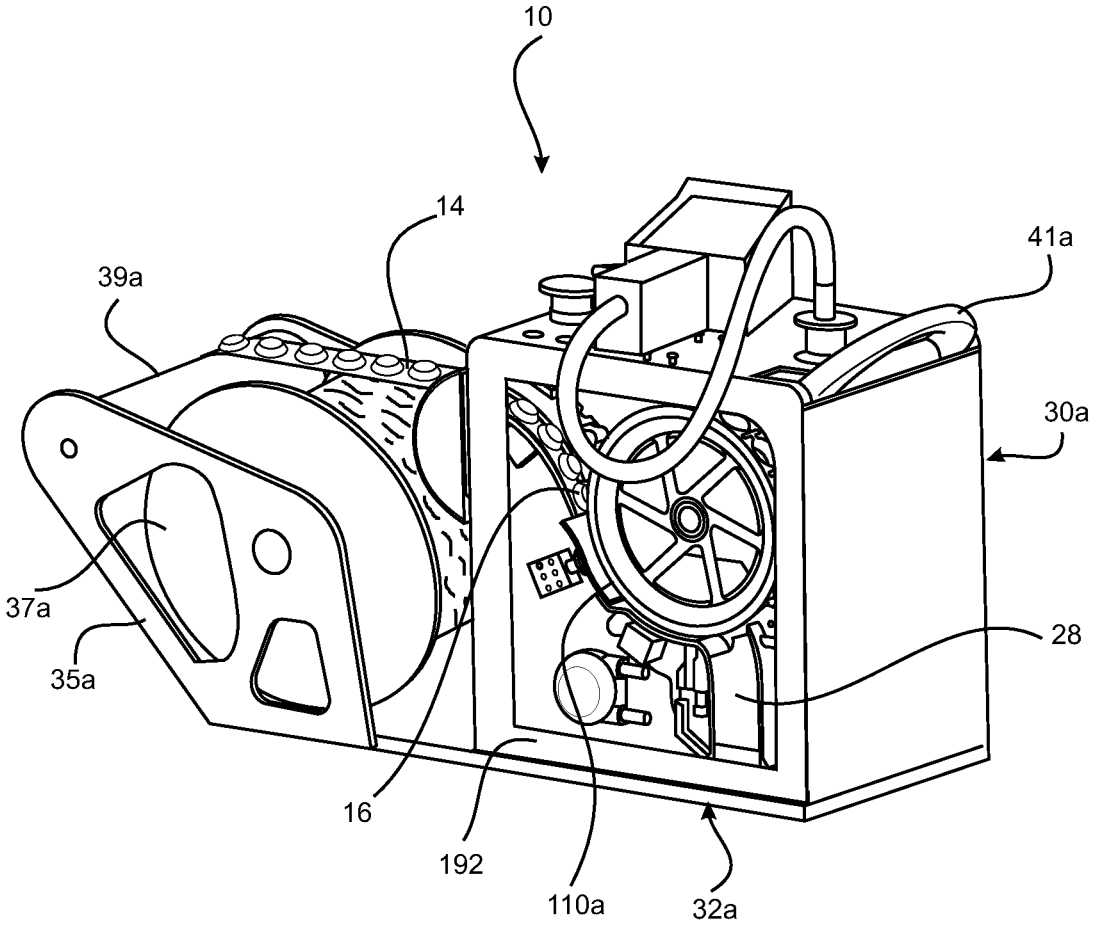

FIG. 15 illustrates a second embodiment of the machine 10*a* having several modifications and variations. Firstly, the pump 22 of the first embodiment is relocated to be on the same side of the fireproof wall 90 as the motors 132 and 134, and thus not visible through the 192 of housing 30*a*. In yet a,further variation a modified frame 32*a* is used in place of frame 32. The frame 32*a* is of simpler construction and is of a planar rectangular configuration onto which the housing 30*a* is demountable coupled. Also rather than having a pivotally coupled tray supporting a box to hold an incendiary belt feed, the frame 32*a* is configured to allow coupling of a pair of plates 35*a* rotatably supporting a drum 37*a* on which the incendiary belt feed is rolled. A further idler roller 39*a* is rotatably supported between the plates 35*a* and about which the incendiary belt travels prior to entry to the housing 30*a*. Housing 30*a* differs slightly from housing 30 by the inclusion of a handle 41*a*.

All such medications and variations together with other that would be obvious to persons of ordinary skill in the art are deemed to be within the scope of the present invention the nature of which is to be determined by the above description and the appended claims.

The invention claimed is:

1. An incendiary machine comprising:

a feed and dispensing system capable of feeding a belt of incendiary capsules to a region at which individual capsules are separated from the belt and dispensed from the machine;

a priming system capable of priming the capsules prior to being dispensed from the machine, the priming system having a pump for pumping a priming liquid which, when delivered into a capsule, facilitates an exothermic reaction;

wherein the priming system comprises an injection device capable of piercing the capsules to deliver the priming liquid to the capsules; and, a control system capable of controlling the feed and dispensing system, and the priming system independently of each other.

2. The incendiary machine according to claim 1 wherein the control system is configured to selectively enable an operator to dispense primed incendiaries either: automatically at a user defined rate; or, manually on each manual operation of a control button or switch.

3. The incendiary machine according to claim 2 wherein the control system comprises a user interface enabling a user to set a rate of automatically dispensing primed incendiaries.

4. The incendiary machine according to claim 1 wherein the control system comprises at least one incendiary sensor for detecting the presence of an incendiary belt in the machine.

5. The incendiary machine according to claim 4 wherein the control system is configured to prevent operation of the priming system when the at least one incendiary sensor fails to detect the presence of an incendiary belt in the machine.

6. The incendiary machine according to claim 1 wherein the control system is operable to perform a LOAD function wherein the control system operates the feed and dispensing system to load a belt of incendiaries to a position where priming system is capable of priming the capsules.

7. The incendiary machine according to claim 1 wherein the control system is operable to perform a PRIME function which primes the priming system with priming fluid prior to feeding of the belt to the region.

8. The incendiary machine according to claim 1 wherein the feed and dispensing system comprises a blade commonly mounted with the injection device and arranged to separate a capsule from the belt substantially simultaneously with the injection device injecting the priming liquid into the capsule.

9. The incendiary machine according to claim 1 wherein the feed and dispensing comprises a carousel provided with a plurality of recesses for seating respective capsules in the belt.

10. The incendiary machine according to claim 9 wherein the feed and dispensing comprises a channel extending from an inlet for the belt to the carousel and a biased plate arranged to bias a capsule into a recess of the carousel.

11. The incendiary machine according to claim 9 comprising a drive system arranged to drive the feed and dispensing system, the drive system comprising a first motor under the control of the control system.

12. The incendiary machine according to claim 11 wherein the drive system comprises a plurality of cogs mounted on respective shafts and operatively coupled together where torque imparted by the first motor to one of the cogs drives the operatively coupled cogs.

13. The incendiary machine according to claim 12 wherein a first cog is coupled with the carousel and a second cog is coupled to the blade and injection device, and the drive system further comprises an endless belt coupling the first cog to the second cog wherein torque from the first motor drives both the carousel and the blade and injection device.

14. The incendiary machine according to claim 1 comprising a pump motor operable to drive the pump, wherein the control system is operable to control the first motor and pump motor independently of each other.

15. The incendiary machine according to claim 1 comprising a housing in which the feed and dispensing system and the priming system are housed and a frame arranged to demountably support the housing and to support an incendiary belt feed.

16. The incendiary machine according to claim 15 comprising a tray pivotally coupled to the frame and on which the incendiary belt feed is supported.

17. An incendiary machine comprising:

a feed and dispensing system capable of feeding a belt of incendiary capsules to a region at which individual capsules are separated from the belt and subsequently dispensed from the machine;

a first motor which drives the feed and dispensing system;

a priming system capable of priming capsules prior to being dispensed from the machine, the priming system having a pump for pumping a priming liquid, and an injection device capable of piercing the capsule to deliver the priming liquid to the capsule;

a second motor which drives the pump; and, a control system capable of independently controlling the first and second motors enabling control of flow of the priming liquid independent of operation of the feed and dispensing system.

18. The incendiary machine according to claim 17 wherein the control system is configured to selectively enable an operator to dispense primed incendiaries either: automatically at a user defined rate; or, manually on each manual operation of a control button or switch.

19. The incendiary machine according to claim 18 wherein the control system comprises a user interface enabling a user to set a rate of automatically dispensing primed incendiaries.

20. The incendiary machine according to claim 17 wherein the control system comprises at least one incendiary sensor for detecting the presence of an incendiary belt in the machine.

21. The incendiary machine according to claim 20 wherein the control system is configured to prevent operation of the priming system when the at least one incendiary sensor fails to detect the presence of an incendiary belt in the machine.

22. The incendiary machine according to claim 17 wherein the control system is operable to perform a LOAD function wherein the control system operates the feed and dispensing system to load a belt of incendiaries to a position where priming system is capable of priming the capsules.

23. The incendiary machine according to claim 17 wherein the control system is operable to perform a PRIME function which primes the priming system with priming fluid prior to feeding of the belt to the region.

* * * * *